US007909937B2

(12) United States Patent
Tallman et al.

(10) Patent No.: US 7,909,937 B2
(45) Date of Patent: Mar. 22, 2011

(54) PROCESS FOR WATER STRIPPING OF PHOTORECEPTORS

(75) Inventors: Kyle B. Tallman, Farmington, NY (US); Steven D. Bush, Red Creek, NY (US); Charles J. Urso, III, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 267 days.

(21) Appl. No.: 12/202,950

(22) Filed: Sep. 2, 2008

(65) Prior Publication Data

US 2010/0051065 A1 Mar. 4, 2010

(51) Int. Cl.
*B08B 3/02* (2006.01)

(52) U.S. Cl. ..... 134/34; 134/32; 134/42

(58) Field of Classification Search ..... 134/34, 134/36, 42, 32
See application file for complete search history.

(56) References Cited

U.S. PATENT DOCUMENTS

| | | | | |
|---|---|---|---|---|
| 4,047,973 | A * | 9/1977 | Williams | 134/10 |
| 4,508,577 | A * | 4/1985 | Conn et al. | 134/1 |
| 5,454,154 | A | 10/1995 | Cherian et al. | |
| 5,670,290 | A | 9/1997 | Manzolati | |
| 6,090,238 | A * | 7/2000 | Smith | 156/344 |
| 6,627,002 | B1 * | 9/2003 | Millonzi et al. | 134/7 |

* cited by examiner

*Primary Examiner* — Michael Barr
*Assistant Examiner* — Saeed T Chaudhry
(74) *Attorney, Agent, or Firm* — Pillsbury Winthrop Shaw Pittman LLP

(57) ABSTRACT

The presently disclosed embodiments relate generally to methods for the removal of coatings from an imaging member for use in electrostatographic, including digital, apparatuses. More particularly, the embodiments pertain to a method for removing at least one electrophotographic imaging layer from an electrophotographic imaging member using ultra-high pressure water.

21 Claims, No Drawings

PROCESS FOR WATER STRIPPING OF PHOTORECEPTORS

BACKGROUND

The presently disclosed embodiments relate generally to methods for the removal of coatings from an imaging member for use in electrostatographic, including digital, apparatuses. More particularly, the embodiments pertain to a method for stripping the electrophotographic imaging layers from an electrophotographic imaging member using ultra-high pressure water.

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating later while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer. Typical multilayered photoreceptors or imaging members have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoating layer and, in some belt embodiments, an anticurl backing layer. These layers are usually formed by a coating process such as dip coating or spraying. Electrophotographic imaging members are commonly utilized in electrophotographic (xerographic) processes in either a flexible belt or a rigid drum configuration. Other members may include flexible intermediate transfer belts that are seamless or seamed, and usually formed by cutting a rectangular sheet from a web, overlapping opposite ends, and welding the overlapped ends together to form a welded seam.

Presently, photoreceptors can be salvaged for reuse if the various electrophotographic imaging layers can be removed from the substrate. Various methods are typically employed for separating the photosensitive layer(s), blocking layer, adhesive layer, and any other layers typically employed in a photoreceptor from the substrate. These methods include cutting the electrophotographic imaging layer from the substrate; exfoliating the coating layer by repeated heating and cooling; heating the coating layer followed by chemical treatment; and heating the coating layer under vacuum to vaporize it. Each of the known methods, however, has residual problems. For example, these removal processes are labor intensive, require an inordinate amount of manufacturing space, and may involve heat and solvents which undesirably damage the underlying substrate. Some of the methods may also evolve dust or emit harmful vapors or poisonous substances and may use environmentally incompatible solvents, thus contributing to the pollution of the environment. Many times, these processes are extremely costly, and often it is more cost effective to sell the photoreceptor as scrap.

In addition to removing the various electrophotographic imaging layers, electrophotographic imaging members having a drum configuration require additional removal steps. For example, drum type photoreceptors are usually supported on an electrically conductive shaft by hubs or end flanges. Often the hub or end flange is secured to the end of the drum by a resin adhesive. In order to clean and recycle the used or defective photoreceptor, the hubs or end flanges must be removed, and the resin adhesive must be stripped off the photoreceptor. Such removal techniques may damage the underlying substrate, may involve complex equipment and is time intensive, and may involve solvents which require special handling and disposal.

Thus, there is a need for a method that facilitates removal of the electrophotographic imaging layers from a substrate which reduces the need for extensive physical manipulation of the photoreceptor, which reduces pollution, which reduces the area dedicated to photoreceptor salvage, which reduces the need to scrap an otherwise functional photoreceptor, and which is faster and relatively less costly to implement than conventional removal methods. There is also a need for a method that facilitates removal of the electrophotographic imaging layers from a substrate so that the substrate can be reused to form new imaging members. Reclaiming the substrate from a photoreceptor is a highly desirable alternative to depositing an otherwise functional photoreceptor in metal reclamation facilities and landfills. In addition, the ability to remove a defective or damaged electrophotographic imaging layer from a substrate without damaging the substrate so that the substrate can be recoated lowers the manufacturing costs of imaging members.

The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

SUMMARY

It is an object of the present invention to faciliate facilitates removal of the electrophotographic imaging layers from a substrate by employing ultra-high pressure water.

It is another object to provide a electrophotographic imaging layer removal method which accomplishes one or more of the following: reduces the need for extensive physical manipulation of the photoreceptor, minimizes pollution, reduces the area dedicated to photoreceptor salvage, which reduces the need to scrap an otherwise functional photoreceptor, and which is quicker and relatively less costly to implement than conventional methods. A further object is to provide processes for the economical removal of laminate type or single layer type photoconductive layers from layered imaging members.

According to aspects illustrated herein, these objects and others are met in embodiments by providing a method for the removal of at least one electrophotographic imaging layer from an electrophotographic photoreceptor comprising an electroconductive substrate having thereon at least one electrophotographic imaging layer, wherein the method comprises subjecting a surface of the substrate to one or more jets of water, the jets being expelled at a pressure of from about 15,000 to 40,000 pounds per square inch until at least one electrophotographic imaging layer is removed from the substrate.

The embodiments also provide a method for removing a electrophotographic imaging layer from at least part of an electrophotographic imaging member substrate having a drum configuration, comprising subjecting a surface of an electrophotographic imaging member to one or more jets of water, the jets being expelled at a pressure of from about 15,000 pounds per square inch to 40,000 pounds per square inch until the electrophotographic imaging layer is removed from at least part of the electrophotographic imaging member substrate.

The embodiments further provide a method for removing at least one electrophotographic imaging layer from an electrophotographic imaging member comprising providing an electrophotographic imaging member having a hollow cylindrical substrate coated with at least one electrophotographic imaging layer and one or more end flanges, the end flanges being attached to the photoreceptor by an adhesive material; removing at least one end flange from the photoreceptor; and propelling water against the imaging member with sufficient force to remove the adhesive material and at least one electrophotographic imaging layer from a surface of the hollow cylindrical substrate.

DETAILED DESCRIPTION

In the following description, it is understood that other embodiments may be utilized and structural and operational changes may be made without departure from the scope of the present disclosure.

The presently disclosed embodiments are directed generally to a method for the removal of at least one electrophotographic imaging layer from an electrophotographic photoreceptor comprising an electroconductive substrate having thereon at least one electrophotographic imaging layer, wherein the method comprises subjecting a surface of the substrate to one or more jets of water, the jets being expelled at a pressure of from about 15,000 to 40,000 pounds per square inch until at least one electrophotographic imaging layer is removed from the substrate.

Any suitable imaging member may be treated with the method of this invention. An electrophotographic imaging member generally comprises at least a substrate layer, an undercoat layer (UCL) and an imaging layer. The undercoating layer is generally located between the substrate and the imaging layer, although additional layers may be present and located between these layers. The imaging member may also include a charge generating layer and a charge transport layer. Thus, the layered material may comprise only one layer, but it typically comprises a plurality of layers such as one or more of the following: one or more photoconductive layers, adhesive layer, charge generating layer, charge transport layer, anti-curling layer, overcoating layer and the like. For the sake of simplification, the various coatings applied to the substrate to form an electrophotographic imaging member will be referred to collectively herein as "at least one electrophotographic imaging layer". Similarly, the expression "drum" is intended to include coated cylindrical photoreceptors and uncoated cylindrical photoreceptor substrates.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The substrate may be flexible or inflexible in the form of an endless flexible belt, a web, a rigid cylinder, a sheet, a drum and the like.

The substrate may be of any dimension conventionally employed in photoreceptors. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device. In various embodiments, uncoated substantially homogeneous aluminum or aluminum alloy drum-type substrates are utilized.

In the present embodiments, the electrophotographic imaging members have a drum configuration, but it could also be in the form of a continuous belt. Electrophotographic imaging members having a drum configuration are usually supported on an electrically conductive shaft by drum supporting hubs or end flanges. Any suitable hub or end flange may be utilized for the adhesively secured drum-flange assembly. Flange may comprise any suitable metal, plastic or combination of a metal and a plastic materials. Although more expensive, typical metals include, for example, steel, aluminum, copper, bronze, brass and the like. Typical plastic materials include thermosetting or thermoplastic resins which are dimensionally stable. These plastic members may be filled or unfilled. Any suitable conventional filling material may be utilized. Typical thermoplastic resins include, for example, acrylonitrile butadiene styrenes (ABS), polycarbonates, nylons, acrylics and the like. Typical thermosetting resins include, for example, alkyds, allylics, epoxies, phenolics, and the like. Any suitable thermoplastic or thermosetting adhesive may be removed with the process of this invention. Typical adhesives include, for example, epoxy, cyanoacrylate, polyurethane, and the like. The adhesive material preferably comprises at least two components such as a resin and a curing agent.

In embodiments, a metal oxide is used, in combination with specific resins, such as polyol and aminplast resins, to form the undercoat layer formulation. In one embodiment, the polyol resin used is acrylic polyol resin. Other polyol resins that may be used are selected from, but are not limited to, the group consisting of polyglycol, polyglycerol and mixtures thereof. The aminoplast resin used with one embodiment may be selected from, but are not limited to, the group consisting of urea, melamine and mixtures thereof. The metal oxide is dispersed in the resins and the dispersion is subjected to heat. In one embodiment, $TiO_2$ is used as the metal oxide in the undercoat layer formulation. In embodiments, $TiO_2$ can be either surface treated or untreated. Surface treatments include, but are not limited to, aluminum laurate, alumina, zirconia, silica, silane, methicone, dimethicone, sodium metaphosphate, and the like and mixtures thereof. Other metal oxides that can be used with the embodiments include, but are not limited to, zinc oxide, tin oxide, aluminum oxide, silicon oxide, zirconium oxide, indium oxide, molybdenum oxide, and mixtures thereof.

Ultra-high pressure water jet systems have a variety of applications which include removal of all types of surface coatings, cleaning, cutting of all types of materials. In various embodiments, an ultra-high pressure water jet system is utilized and is commercially available from NLB Corp. (Ultra-Clean 40® Model No. 4075 E). The sample photoreceptor is mounted between one or more high precision mounts or grippers of the water jet system. Water is directed at the photoreceptor through a nozzle on the water jet system. The nozzle is positioned at a selected proximity and orientation to the surface of the sample photoreceptor which is held by the mount or gripper. The nozzle is employed to direct and focus water at the adhesive coating and along a longitudinal axis of the electrophotographic imaging member. If desired, multiple nozzles may be employed to reduce cycle time during which the electrophotographic imaging layer is removed. Generally, the end of the nozzle is spaced very closely to the surface of the imaging member. Typical distances are between about 0.5 inches and about 2.5 inches.

Rotation of the imaging member further assists in the removal of at least one electrophotographic imaging layer from the substrate. With the nozzle directed at the imaging member, the imaging member is rotated about its horizontal axis such that the imaging member is turning into the direction of the water to create a peeling effect. Water is directed through the nozzle at the surface of the imaging member. Although filtered well water and filtered city water can be used, reverse osmosis/deionized (RO/DI) water is preferable as it reduces the chance of impurities that can cause coating defects on the imaging member. The stream of water may be continuous or intermittent.

During the application of ultra-high pressure water to the photoreceptor, different variables are optimized to achieve effective removal of different types of electrophotographic imaging layers including the water pressure, the distance between the nozzle and the photoreceptor surface, the horizontal and vertical traverse rate of the nozzle, and the angle of the nozzle in relation to photoreceptor. These variables are controlled by a computer on the ultra-high pressure water jet system, and are programmed through an operator interface on the computer. The water pressure utilized to propel water against the adhesive layer and the surface of the electrophotographic imaging member can vary depending on the type of overcoat layer used, preferably between about 15,000 to about 40,000 psi. When lower pressures are used, the momentum of water striking the adhesive coating or the surface of the electrophotographic imaging member may be insufficient to remove all of the layered materials. Higher water pressures could also damage the underlying substrate.

The sample photoreceptor is rotated as water is directed at its surface, typically at a speed of at least about 900 revolutions per minute. The number of revolutions of the drum during the exposure of the adhesive or electrophotographic imaging layer should be sufficient to subject all of the photoreceptor surface to the water. However, at lower speeds, water tends to damage the substrate. In one embodiment, the rotation speed of the imaging member can be measured according to the pressure at which the air motor is operating. The rotation speed may also be based on the air motor pressure, and can range from about 8 psi and about 10 psi. However, the rotation speed of the imaging member may be measured by any suitable device.

One or more nozzles traverse the length of the electrophotographic imaging member, preferably at a rotational speed ranging from about 5 inches per minute and about 50 inches per minute, or from about 20 inches per minute to about 35 inches per minute. Slower traverse rates allow water to damage the drum, and higher traverse rates do not remove all of the layers completely. Typical rotating devices for the drum may include, for example, parallel support rollers in which at least one roller is driven, chucks which grip and rotate the drum, air bladders, and the like. The nozzle may be moved relative to a stationary or rotating drum. Moreover, both the nozzle and the cylinder may be moved relative to each other.

Water is directed at the photoreceptor through one or more nozzles on the water jet system. The nozzle design is conventional, and the type of nozzle used depends upon whether the nozzle is directed to the removal of the end flange or the removal of the adhesive material and the electrophotographic imaging layers. In one embodiment, water is forced through a 15° fan-type nozzle during removal of the adhesive and the imaging layers. In another embodiment, a 10° fan-type nozzle is used.

Removal of the end flanges and adhesive is effected by the high pressure impact of the water on the end flanges of the electrophotographic imaging member and the adhesive. In one embodiment, ultra-high pressure water is used to cut and remove both the flange and the adhesive glue from the photoreceptor. The sample photoreceptor is positioned between one or more high precision mounts of the water jet system. A rotary type nozzle such as a 45° twin cutting head or a Bi-0° metal cutting head is then used to direct water at the end flanges of the drum assembly, preferably at a water pressure between about 10,000 psi and about 20,000 psi. Generally, satisfactory results are achieved with a sample rotational speed between about 2000 revolutions per minute and about 3000 revolutions per minute. The cycle time ranges between about 5 seconds and about 7 seconds.

In yet another embodiment, the flange is mechanically removed from the photoreceptor before ultra-high pressure water is used to remove the residual adhesive glue and any remaining remnants of the flange. The sample photoreceptor is positioned between one or more high precision mounts or the grippers of the water jet system. The sample is directed to the deflange station on the water jet system, and a bore tool is directed through the center of the photoreceptor which allows for a larger diameter flange removal tool to be utilized to push the flanges from the photoreceptor. A flange removal tool is utilized to apply pressure to a rear portion of the end flanges such that the rear portion can be pushed through the front portion of the end flanges. Subsequently, the front portion of the end flanges is then pulled out of the photoreceptor.

The nozzle on the water jet system is employed to direct and focus water at the flange and adhesive material present on the inside surface of the ends of the hollow cylindrical imaging member. In addition to removing adhesive from the inner surface of the ends of hollow cylindrical imaging members or drums, the method may also be used to remove adhesive material from the outer periphery of flanges after they have been removed from the ends of the hollow cylindrical imaging members. The ends of the photoreceptor may vary in size and shape.

Once the adhesive material and at least one electrophotographic imaging layer has been removed from the photoreceptor, the photoreceptor is directed to the steam bath chamber in the water jet system for steam treatment. The photoreceptor is then subjected to a hot water spray. The dwell time, steam pressure, and temperature are programmed through a user interface on a computer of the water jet system. The dwell time that the photoreceptor is subjected to the hot water spray ranges from about 30 seconds to about 1 minute.

After the hot water spray or steam bath, the photoreceptor is subjected to a hot air treatment. The dwell time that the photoreceptor is subjected to hot air ranges from about 30 seconds to about 1 minute, and the temperature of the hot air is preferably no higher than 200° C. In the embodiments, it is preferable that the dwell time that the photoreceptor is subjected to the hot water spray and the hot air remain the same.

The terms "removal" or "removed" refers to the complete or partial disintegration of the electrophotographic imaging layer and partial or full separation of photoreceptor layers from one another or from the substrate and includes the phenomena of fracturing, flaking off, and peeling. Electrophotographic imaging layers which still adhere to the photoreceptor may be considered "removed" if it exhibits signs of cracking, peeling, and the like. The nature of how the electrophotographic imaging layer becomes removed depends at least partly upon its composition.

high pressure water jet system. The ultra-high pressure water jet system is the ULTRA-CLEAN 40®, Model 4075E, available from NLB Corporation. The photoreceptor has the following dimensions and composition: 40 millimeters in diameter, 360 millimeters in length, and a photoconductive layer comprising $TiSiO_2$. Ultra-high pressure water is directed at the photoreceptor. Conditions for the removal were as follows: Water Pressure: 35,000 PSI. Water flow rate: 3.02 GPM. Cycle Time: 30 seconds. Rotation speed based on air motor: 8-10 PSI. Horizontal travel rate: 30 inches per minutes. Nozzle type: 15° Fan. The photoreceptors were visually evaluated to determine removal.

Results

The results of the removal testing are summarized in Table I below. Testing of the photoreceptor indicates that removal of the layered material from the substrate was successful. Trials indicate under the optimized process conditions identified below that there is 100% removal of the adhesive glue and a 96% removal of the electrophotographic imaging layers.

TABLE 1

Experimental Results

| Sample: Undercoat Layer Type | Water Pressure (PSI) | Water Flow Rate (GPM) | Actual Cycle Time (sec) | Rotation speed based on air motor (PSI) | Horizontal travel rate (Inch/min.) | Nozzle Type |
|---|---|---|---|---|---|---|
| TiSiO2 | 35,000 | 3.02 | 30 | 8-10 | 30 | 15° Fan |
| TUC - $TiO_2$ based | 35,000 | 3.02 | 39 | 8-10 | 20 | 15° Fan |
| 3C | 36,000 | 3.02 | 180 | 8-10 | 5 | 15° Fan |
| FX DUC - Zinc oxide based | 18,000 | 3.02 | 18 | 8-10 | 50 | 15° Fan |
| Flange Removal 40 mm | 20,000 | 0.95 each for two cutters | 10 | Unknown | 5 | Bi-0° Metal Cutting Head |

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

A drum photoreceptor comprising an aluminum substrate and a $TiSiO_2$ undercoat layer (UCL) is mounted in a ultra-

Example 2

An electrophotographic photosensitive member was produced in the same manner as in Example 1 except that, the UCL used was titanium-oxide based, the cycle time was 39 seconds, the horizontal traverse rate was 20 inches per minutes. Evaluation was made in the same way. The results are shown in Table 1.

Example 3

An electrophotographic photosensitive member was produced in the same manner as in Example 1 except that, a three-component (3C) UCL was used for the UCL. The 3C UCL comprises N-butyl alcohol, polyvinyl butyral binder (BMS) (available from Inabata & Co., Ltd., Japan), tributoxyzirconium acetyl acetonate (ZC540-S) (available from Matsumoto Kosho K.K., Japan) and γ-aminopropyltrimethoxysilane (A-1100) (available from Contivema B.V., Netherlands). The UCL was applied in a thickness of approximately 0.8 micrometers to 1.3 micrometers to the cleaned honed substrate by dip coating. Evaluation was made in the same way. The results are shown in Table 1.

Example 4

An electrophotographic photosensitive member was produced in the same manner as in Example 1 except that, a zinc-based layer was used for the UCL. The UCL was applied in a thickness of approximately 18 micrometers to 24 micrometers to the cleaned honed substrate by dip coating. Evaluation was made in the same way. The results are shown in Table 1.

Example 5

An electrophotographic photosensitive member was provided comprising a hollow aluminum drum substrate supported on an electrically conductive shaft by drum supporting hubs or end flanges. To remove the end flanges, a bore tool is used to bore a hole into the drum photoreceptor. A flange removal tool is then inserted into the bored hole to push out the rear flange portion. The flange removal tool can be rotated at a rate of about 3000 revolutions per minute, and the water pressure is about 18,000 psi with a flow rate of 0.95 gpm. The flange removal tool is retracted to pull out the front flange portion. The remnants of the flange are then removed from the press arm, which may include blowing off the flange ring. Once the flange is mechanically removed, the photoreceptor is directed to the ultra-high pressure water jet system where ultra-high pressure water is propelled at the adhesive glue to blast the adhesive glue off the ends of the drum photoreceptor. Water pressure was 20,000 psi. The horizontal travel rate was 5 inches per minute.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for the removal of at least one electrophotographic imaging layer from an electrophotographic photoreceptor comprising an electroconductive substrate having at least one electrophotographic imaging layer thereon, wherein the method comprises subjecting a surface of the electrophotographic photoreceptor to one or more jets of water, the jets being expelled at a pressure of from about 15,000 to about 40,000 pounds per square inch until at least one electrophotographic imaging layer is removed from the electroconductive substrate.

2. The method of claim 1 wherein the electrophotographic photoreceptor further comprises one or more end flanges, the end flanges being attached to the electrophotographic photoreceptor by an adhesive material.

3. The method of claim 2, further including removing at least one end flange and the adhesive material with the jets of water as used to remove the at least one electrophotographic imaging layer from the electroconductive substrate.

4. The method of claim 3, wherein at least one end flange is removed before the adhesive material is removed by the jets of water.

5. The method of claim 1 wherein the jets of water are expelled from one or more nozzles.

6. The method of claim 5, wherein the nozzle is a 15° fan nozzle.

7. The method of claim 5, wherein the nozzle is a Bi-0° metal cutting head nozzle.

8. The method of claim 5, wherein the nozzle concentrates water along a longitudinal axis of the electrophotographic photoreceptor.

9. The method of claim 5, wherein the nozzle has a horizontal travel rate from about 5 to about 50 inches per minute.

10. The method of claim 1, further including rotating the electrophotographic photoreceptor while subjecting the surface of the electrophotographic photoreceptor to one or more jets of water.

11. The method of claim 10, wherein the electrophotographic photoreceptor is rotated by an air motor.

12. The method of claim 11, wherein the rotation speed of the photoreceptor is determined from an operating pressure of the air motor, the operating pressure being from about 8 psi to about 10 psi.

13. The method of claim 1, wherein the electrophotographic imaging layer comprises one or more of a laminate or single layer photoconductive layer, an adhesive layer, a charge blocking layer, an anti-curling layer, and an overcoating layer, wherein at least a portion of the electrophotographic imaging layer is removed from the photoreceptor.

14. The method of claim 1, the electrophotographic imaging layer is comprised of a metal oxide selected from the group comprising a titanium oxide and zinc oxide.

15. The method of claim 1, wherein the substrate is fabricated entirely of a conductive metal.

16. A method for removing a electrophotographic imaging layer from at least part of an electrophotographic imaging member substrate having a drum configuration, comprising subjecting a surface of an electrophotographic imaging member to one or more jets of water, the jets being expelled at a pressure of from about 15,000 pounds per square inch to 40,000 pounds per square inch until the electrophotographic imaging layer is removed from at least part of the electrophotographic imaging member substrate.

17. The method of claim 16, wherein the jets of water are expelled from one or more nozzles, the nozzle being selected from a group comprising a 15° fan nozzle and Bi-0° metal cutting head nozzle.

18. The method of claim 16, wherein the electrophotographic imaging layer comprises one or more of a laminate or single layer photoconductive layer, an adhesive layer, a charge blocking layer, an anti-curling layer, and an overcoating layer, wherein at least a portion of the electrophotographic imaging layer is removed from the electrophotographic imaging member substrate.

19. The method of claim 16, wherein the electrophotographic imaging member further comprises one or more end flanges, the end flanges being attached to the electrophotographic imaging member by an adhesive material.

20. The method of claim 19, including removing at least one end flange and the adhesive material with the jets of water as used to remove the at least one electrophotographic imaging layer from the electroconductive substrate.

21. A method for removing at least one electrophotographic imaging layer from an electrophotographic imaging member comprising:

providing an electrophotographic imaging member having a hollow cylindrical substrate coated with at least one electrophotographic imaging layer and one or more end flanges, the end flanges being attached to the photoreceptor by an adhesive material;

removing at least one end flange from the photoreceptor; and propelling water against the imaging member with sufficient force to remove the adhesive material and at least one electrophotographic imaging layer from a surface of the hollow cylindrical substrate, wherein water is expelled from one or more nozzles at a pressure of from about 15,000 pounds per square inch to about 40,000 pounds per square inch.

* * * * *